US009622577B2

(12) United States Patent
Wirthlin et al.

(10) Patent No.: US 9,622,577 B2
(45) Date of Patent: Apr. 18, 2017

(54) GUN SAFE STORAGE SYSTEM

(71) Applicant: Fort Knox, Inc., Orem, UT (US)

(72) Inventors: David G. Wirthlin, Highland, UT (US); Steven M. Shermersheim, Lehi, UT (US); C. Thomas James, Orem, UT (US)

(73) Assignee: FORT KNOX, INC., Orem, UT (US)

( * ) Notice: Subject to any disclaimer, the term of this patent is extended or adjusted under 35 U.S.C. 154(b) by 0 days.

(21) Appl. No.: 14/508,935

(22) Filed: Oct. 7, 2014

(65) Prior Publication Data

US 2016/0095432 A1 Apr. 7, 2016

(51) Int. Cl.
*A47B 81/00* (2006.01)
*F41C 33/06* (2006.01)

(52) U.S. Cl.
CPC ..... *A47B 81/005* (2013.01); *F41C 33/06* (2013.01)

(58) Field of Classification Search
CPC ..... A47B 46/00; A47B 46/005; A47B 49/00; A47B 49/004; A47B 61/02; A47B 81/00; A47B 81/005; A47B 88/18; A47B 96/02; A47B 96/021; A47B 96/024; A47B 96/025; A47B 96/06; A47B 96/066; A47B 96/068; A47B 96/16
USPC ..... 109/45, 47–49, 53, 64
See application file for complete search history.

(56) References Cited

U.S. PATENT DOCUMENTS 637,168 A * 11/1899 Shoemaker ..... A47B 53/00 312/278
2,086,019 A * 7/1937 Dyer ..... F25D 23/12 109/23
2,457,248 A * 12/1948 Lemke ..... 312/329
2,465,555 A * 3/1949 Smith ..... E05F 17/004 312/275
2,692,813 A * 10/1954 Toronto ..... F25D 25/02 312/329
2,702,734 A * 2/1955 Kroll ..... 312/275
3,807,826 A * 4/1974 Peckenpaugh ..... 312/305
D277,628 S * 2/1985 Shaw ..... D6/705.7
5,158,186 A * 10/1992 Krut ..... B42F 15/0094 211/113
5,505,317 A * 4/1996 Rulis ..... A47B 46/00 211/119.004
5,536,081 A * 7/1996 Pokhis ..... 312/321.5
6,042,207 A * 3/2000 Crosby et al. ..... 312/351
7,409,790 B2 * 8/2008 Stepp ..... 42/70.01
7,712,849 B2 * 5/2010 Jakins et al. ..... 312/314
7,877,920 B2 * 2/2011 Szuminski et al. ..... 42/70.01
8,292,094 B2 * 10/2012 Morton ..... 211/64
2004/0140280 A1 * 7/2004 Cleveland et al. ..... 211/64
2006/0283820 A1 * 12/2006 Peters et al. ..... 211/64
2007/0024165 A1 * 2/2007 Moulton ..... 312/291
2008/0229983 A1 * 9/2008 Pendleton ..... 109/45
(Continued)

*Primary Examiner* — Andrew Roersma
(74) *Attorney, Agent, or Firm* — Maschoff Brennan

(57) ABSTRACT

A gun safe is disclosed. In some embodiments, the gun safe may include a safe body defined at least by a back, a first side, a second side, a top, a bottom, and a front, the front comprising an opening; a door coupled with the first side and/or the front and configured to open and close; a lower shelf coupled with the door having a first shape; and an upper shelf coupled with the door, the upper shelf having a second shape and comprising a plurality of holes configured to secure a barrel of a firearm.

19 Claims, 15 Drawing Sheets

(56) References Cited

U.S. PATENT DOCUMENTS

| | | | | |
|---|---|---|---|---|
| 2013/0002116 | A1* | 1/2013 | Lodge et al. | 312/351.1 |
| 2015/0101516 | A1* | 4/2015 | Suggs | 109/64 |

* cited by examiner

GUN SAFE STORAGE SYSTEM

FIELD

This disclosure relates generally to vertical gun safe storage system for gun safe.

BACKGROUND

The use of safes for storing and protecting firearms is well known. Traditional gun safes secure firearms by providing shelving inside the safe's main compartment, the most popular designs generally consisting of vertical compartments with guns placed in a side by side arrangement. Such systems are limited in terms of the accessibility and space efficiency they can provide to consumers. Embodiments of the present invention solve one or more shortcomings of the prior art.

The subject matter claimed herein is not limited to embodiments that solve any disadvantages or that operate only in environments such as those described above. Rather, this background is only provided to illustrate one exemplary technology area where some embodiments described herein may be practiced.

SUMMARY

A gun safe is disclosed according to some embodiments described herein. In some embodiments, the gun safe may include a safe body defined at least by a back, a first side, a second side, a top, a bottom, and a front, the front comprising an opening; a door coupled with the first side and/or the front and configured to open and close; a lower shelf coupled with the door having a first shape; and an upper shelf coupled with the door, the upper shelf having a second shape and comprising a plurality of holes configured to secure a barrel of a firearm.

A gun storage system is also disclosed according to some embodiments described herein. The gun storage system may include, for e a lower shelf having a first shape, the lower shelf comprising a ridge extending along at least a portion of the length of one or more edges and a mounting bracket that is coupled with and perpendicular to the lower shelf; and an upper shelf having a second shape, the upper shelf comprising a plurality of holes configured to secure a barrel of a firearm and a mounting bracket that is coupled with and perpendicular to the upper shelf.

Some embodiments include a gun safe having a top shelf and a bottom shelf attached with an interior surface of the gun safe's door configured to store more than one row of guns.

Some embodiments include a gun safe having a top shelf and a bottom shelf attached with an interior surface of a door where the top shelf and/or the bottom shelf extend past an interior surface edge of the gun safe's door.

Some embodiments include a gun safe having a top shelf and a bottom shelf attached with an interior surface of a door where the top shelf and/or the bottom shelf extend half way across an interior surface of the gun safe's door.

Some embodiments include a gun safe having a top shelf and a bottom shelf attached with an interior surface of a door where the top shelf and/or the bottom shelf extend across only a portion of the interior surface of the gun safe's door.

Some embodiments include a gun safe having a wedge shaped top shelf and a wedge shaped bottom shelf attached with an interior surface of the gun safe's door.

These illustrative embodiments are mentioned not to limit or define the disclosure, but to provide examples to aid understanding thereof. Additional embodiments are discussed in the Detailed Description, and further description is provided there. Advantages offered by one or more of the various embodiments may be further understood by examining this specification or by practicing one or more embodiments presented.

BRIEF DESCRIPTION OF THE FIGURES

These and other features, aspects, and advantages of the present disclosure are better understood when the following Detailed Description is read with reference to the accompanying drawings.

DETAILED DESCRIPTION

Figure 1A:
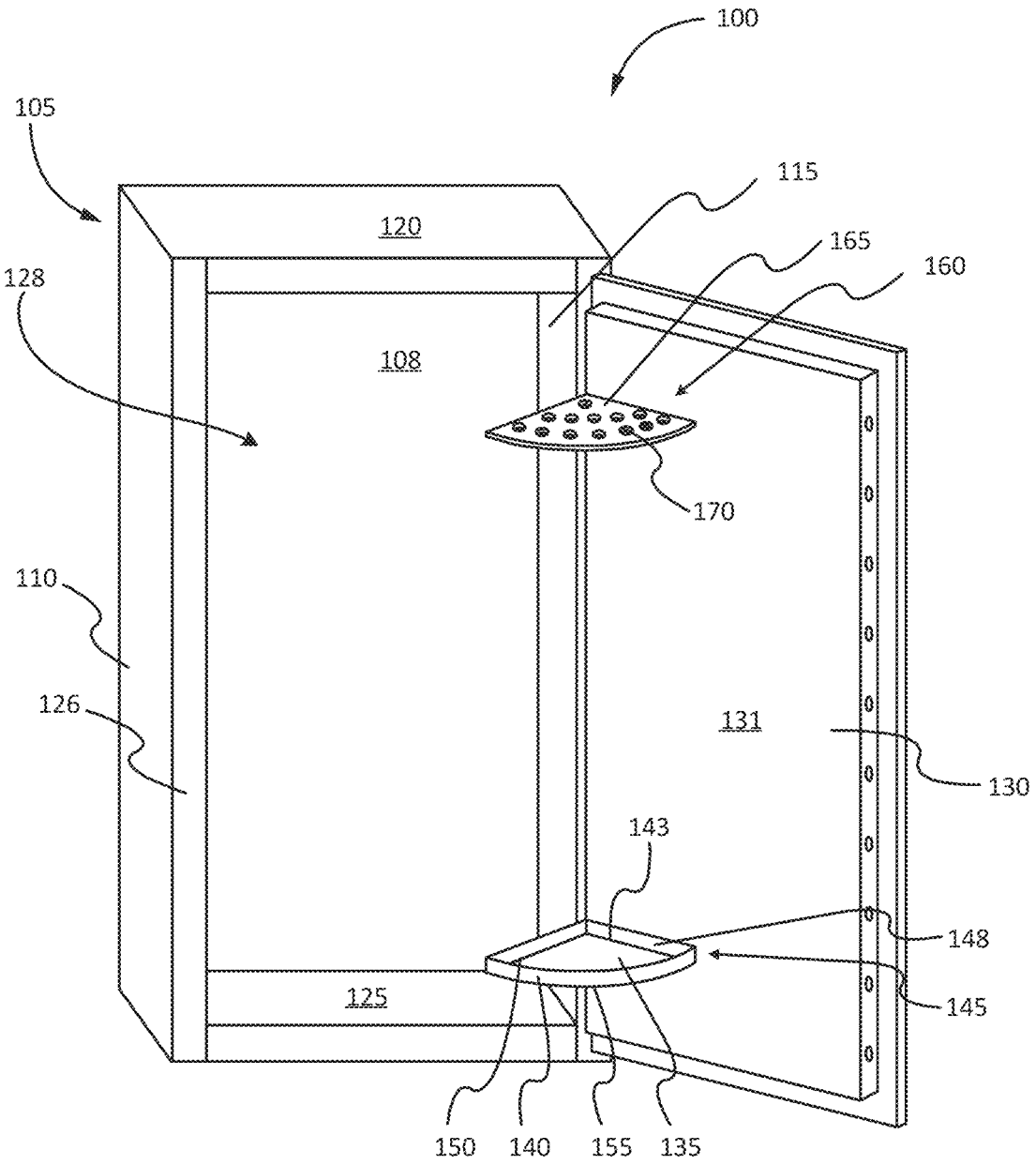
FIG. 1A and FIG. 1B illustrate perspective views of a gun safe storage system according to some embodiments described herein.
Figure 1B:
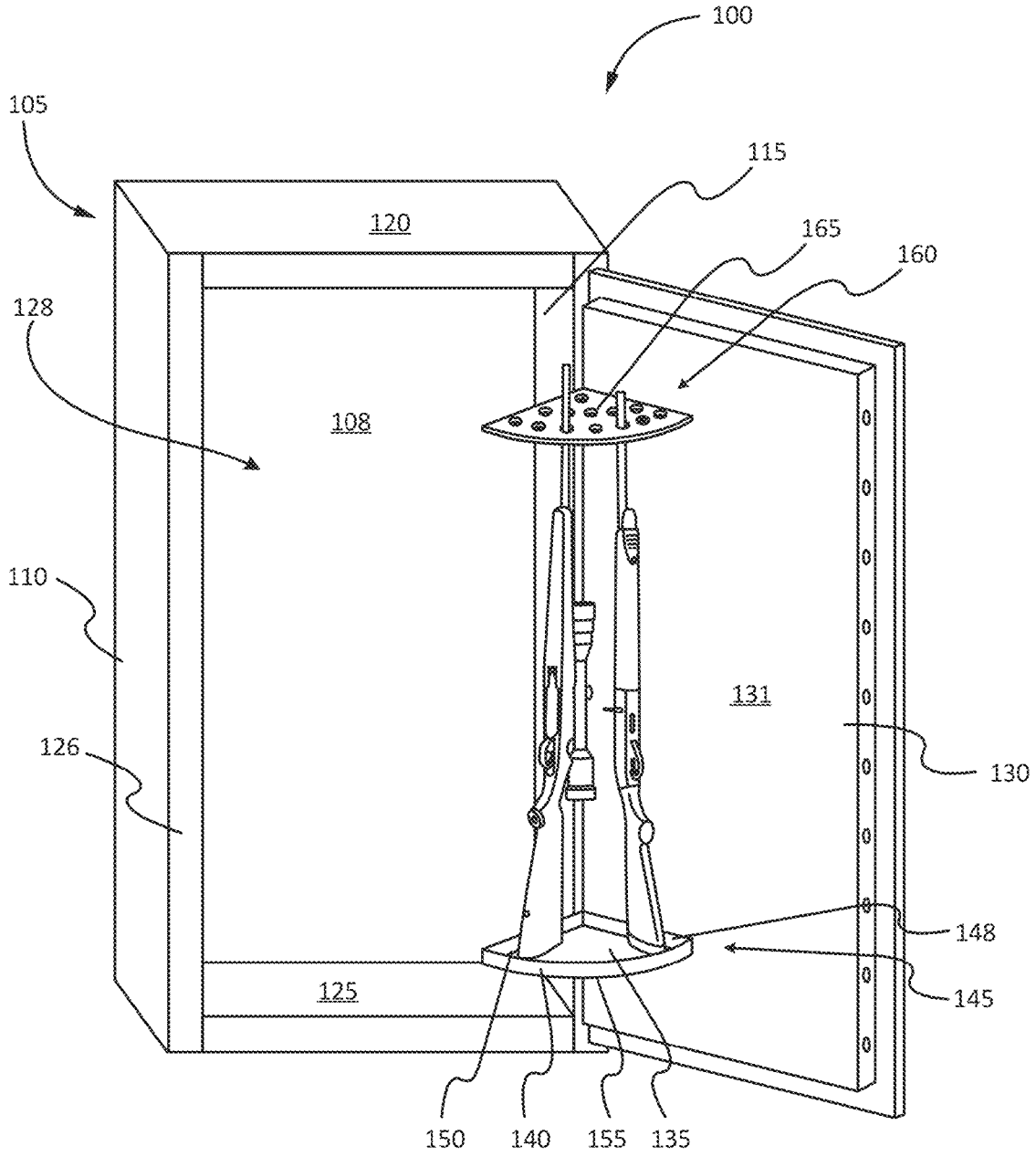

FIG. 1A illustrates an example gun safe 100 according to some embodiments described herein. FIG. 1B illustrates the gun safe 100 with two guns secured within the gun safe 100. The gun safe 100 includes a safe body 105 with a back 108, a first side 115, a second side 110, a top 120, a bottom 125 and a front 126. The front 126 may include an opening 128. The interior of the safe body 105 may be accessible through the opening 128 and any contents thereof may be secured to an interior surface 131 of a door 130.

The door 130 may be attached with the first side 115 and/or the front 126 of the gun safe 100. The door may be attached with first side 115 and/or the front 126, for example with one or more hinges that may be coupled with the first side 115 and/or the front 126. The door 130 may include one or more locks, bolts, jams, etc.

In some embodiments, two shelves may be attached to the interior surface 131 of the door 130. As shown in FIG. 1B, the lower shelf 135 may include a bottom platform 145 to hold the stocks of one or more guns and an upper shelf 160 that may secure the barrels or the one or more guns. In some embodiments, the lower shelf 135 may include a bottom platform 145 with at least three edges: a first edge 143, a second edge 150, and/or a third edge 155.

Figure 2A:
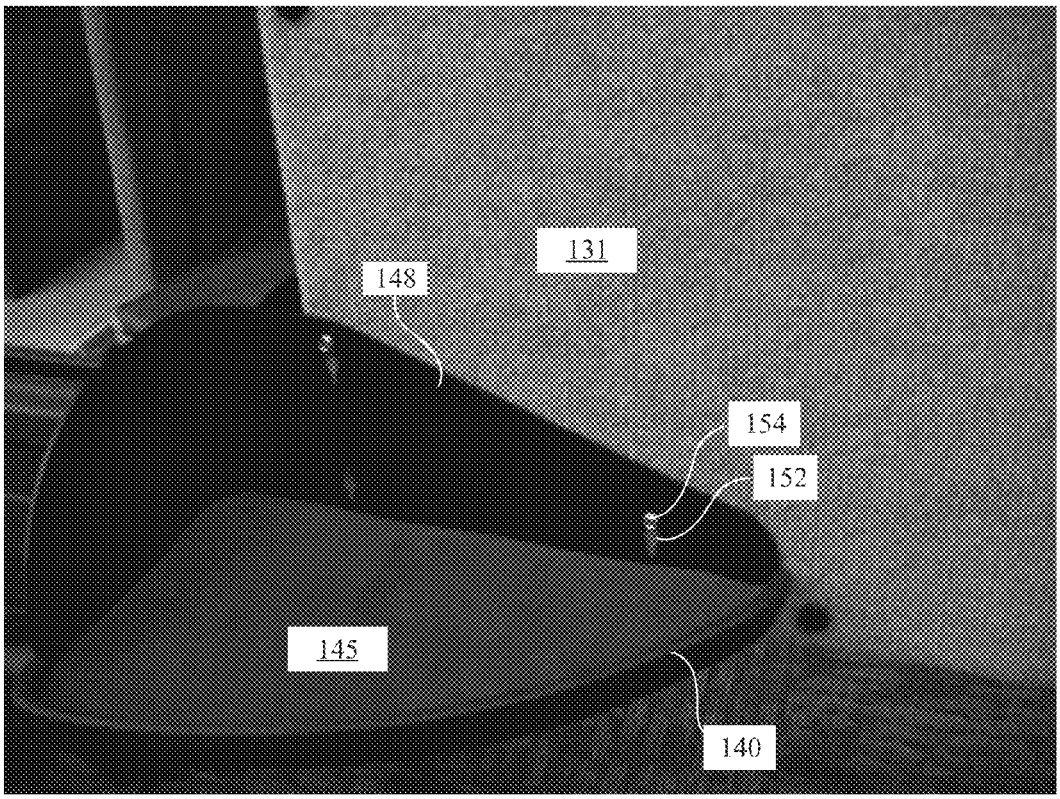
FIG. 2A illustrates a lower shelf of a gun safe storage system according to some embodiments described herein.

In some embodiments, the first edge 143 may be straight and may extend from a junction with the second edge 150 to a junction with the third edge 155. In some embodiments, the junction of the first edge 143 with the second edge 150 may be at point disposed at or near the interior surface 131 of the door 130 and/or at a point near the edge of the interior surface 131 of the door 130. In some embodiments, the junction of the first edge 143 with the second edge 150 may be disposed at a point not near the edge of the interior surface 131 of the door 130 (e.g., as shown in FIG. 2A). In some embodiments, the junction of the first edge 143 with the second edge 150 may extend past the edge of the interior surface 131 of the door 130 (e.g., as shown in FIG. 2A). In some embodiments, the junction of the first edge 143 with the second edge 150 may form a ninety degree angle (within manufacturing tolerances).

In some embodiments, the bottom platform 145 may be coupled with the interior surface 131 of the door 130 such that the first edge 143 may extend from an edge of the interior surface 131 of the door 130 to (or toward) the middle (as measured horizontally) of the interior surface 131 of the door 130. In some embodiments, the first edge 143 may extend from an edge of the interior surface 131 of the door 130 to (or toward) the other edge of the interior surface 131 of the door 130 and/or any other portion of the interior surface 131 of the door 130. In some embodiments, the bottom platform 145 may be coupled with the interior surface 131 of the door 130 so that when the door 130 is closed the second edge 150 of the bottom platform 145 is disposed near the inside surface of the first side 115 of the safe body 105.

In some embodiments, the second edge 150 may be straight and may extend from a junction with the first edge 143 to a junction with the third edge 155. In some embodiments, the junction of the second edge 150 with the first edge 143 may be at point disposed at or near the interior surface 131 of the door 130 and/or at a point near the edge of the interior surface 131 of the door 130. In some embodiments, the second edge 150 may the junction of the second edge 150 with the first edge 143 may be disposed at a point not near the edge of the interior surface 131 of the door 130 (e.g., as shown in FIG. 2A).

In some embodiments, the third edge 155 may be curved and may extend from a junction with the second edge 150 to a junction with the third edge 155. The junction of the third edge 155 with the first edge 143 may be at point disposed at or near the interior surface 131 of the door 130 and/or at a point near the middle (or any other portion of the interior surface 131) of the interior surface 131 of the door 130. In some embodiments, the bottom platform 145 and the third edge 155 may form a 90 degree angle with respect to each other.

The first edge 143 of the bottom platform 145 may be coupled perpendicularly (within manufacturing tolerances) with the interior surface 131 of the door 130. The bottom platform 145 may include a lower mounting bracket 148. The mounting bracket, for example, may be coupled at least with a portion with the first edge 143 and/or a portion of the second edge 150 of the bottom platform 145. The lower mounting bracket 148 may include at least a portion that is perpendicular with the bottom platform 145 and/or parallel with the interior surface 131 of the door 130. The lower mounting bracket 148, for example, may include one or more holes through which the lower mounting bracket 148 may be secured with the interior surface 131 of the door 130 using a fastener such as, for example, screws and/or bolts. In some embodiments, the mounting bracket may include a portion that extends upwardly relative to the bottom platform 145 and/or the interior surface 131 of the door 130. In some embodiments, the mounting bracket may include a portion that extends downwardly relative to the bottom platform 145 and/or the interior surface 131 of the door 130.

In some embodiments, the lower shelf 135 may include a ridge (or lip) 140 that surrounds at least a portion of the perimeter of the bottom platform 145. In some embodiments, the ridge 140 may include one or more ridges coupled with one or more of the first edge 143, the second edge 150, and/or the third edge 155. The ridge 140 may provide lateral support of gun stocks as the door is swung open and closed. The ridge 140 may extend along at least a portion of the bottom platform 145, the first edge 143, the second edge 150, the third edge 155, and/or any combination thereof. The ridge 140 may include a vertical lip, a vertical sheet, a perpendicular sheet, a railing, a netting structure, and/or a series of vertical posts, etc. In some embodiments, the ridge 140 and/or the lower mounting bracket 148 may comprise a single component.

In some embodiments, the lower shelf 135 may include more or less than three sides. For example, the lower shelf 135 may be in the shape of a square, rectangle, semi-circle, polygon, etc.

In some embodiments, the bottom platform 145 may include a padded top surface such as, for example, foam, fabric, leather, rubber, etc.

In some embodiments, the bottom platform 145 may have a wedge shape (or quarter circle shape) that includes two straight edges (e.g., the first edge 143 and the second edge 150) and a curved edge (e.g., the third edge 155). In some embodiments, the bottom platform 145 may have a right-angled wedge shape that includes two straight edges (e.g., the first edge 143 and the second edge 150) at right angles and a curved edge (e.g., the third edge 155).

Figure 2B:
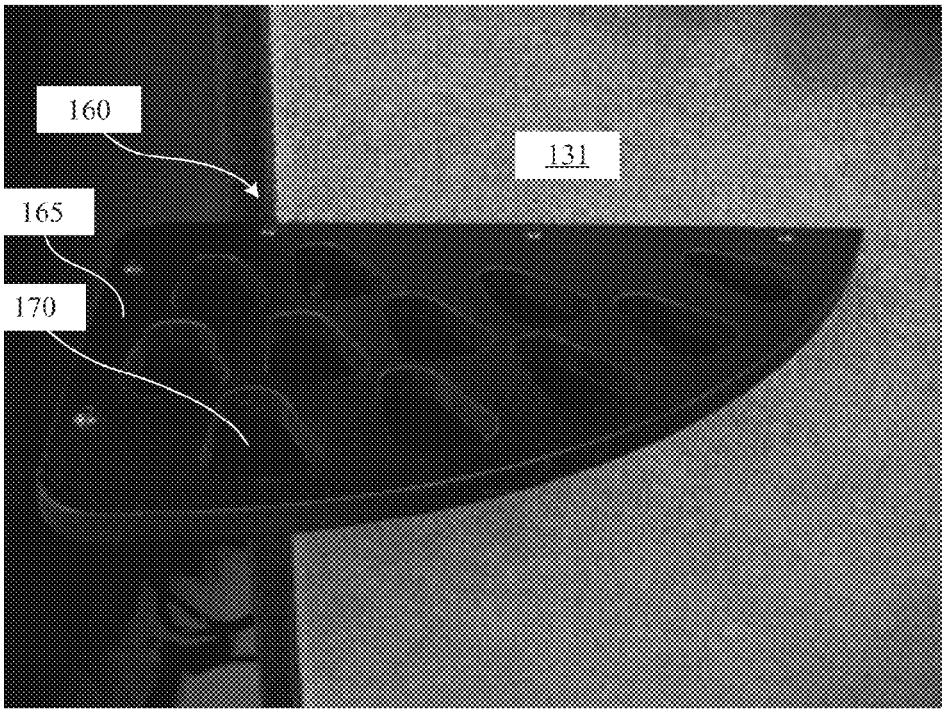
FIG. 2B and FIG. 2C illustrates an upper shelf of a gun safe storage system according to some embodiments described herein.

In some embodiments, as shown in FIG. 2B, the upper shelf 160 may secure the barrels of guns being stored. For example, the upper shelf 160 may include a top platform 165 that includes a plurality of holes 170. Each of the plurality of holes 170 may have a shape that is circular, oval, square, polygonal, oblong, triangular, etc. In use, for example, a barrel of a gun may be placed within one of the plurality of holes 170 to aide in securing a gun within the holes.

In some embodiments, a subset of the plurality of holes 170 may be arranged in a first row, a second row, and a third row. For example, the first row may include a subset of the plurality of holes 170 and may extend laterally in a direction roughly parallel with the interior surface 131 of the door 130. The second row may also include a subset of the plurality of holes 170 and may extend laterally in a direction roughly parallel with the interior surface 131 of the door 130. The third row may also include a subset of the plurality of holes 170 and may extend laterally in a direction roughly parallel with the interior surface 131 of the door 130. The first subset of holes may include fewer holes than the second subset and the third subset. The second subset of holes may include fewer holes than the third subset.

In some embodiments, a subset of the plurality of holes 170 may be arranged in a first row, a second row, and a third row. For example, as shown in FIG. 2B, the first row may include a first subset of the plurality of holes 170 and may be arranged in a curved pattern that roughly follows a curved edge of the top platform 165. The second row may include a second subset of the plurality of holes 170 and may also be arranged in a curved pattern that roughly follows a curved edge of the top platform 165. The third row may include a third subset of the plurality of holes 170 and may also be arranged in a curved pattern that roughly follows a curved edge of the top platform 165. The first subset of holes may include fewer holes than the second subset and the third subset. The second subset of holes may include fewer holes than the third subset.

In some embodiments, top platform 165 may have the same shape as the bottom platform 145. In some embodiments, the shape of the top platform 165 and/or the bottom platform 145 may have a similar size and/or shape. In some embodiments, the shape of the top platform 165 and/or the bottom platform 145 may vary, for example, to improve the space efficiency of the storage system. In some embodiments. For example, the top platform 165 may have a similar shape as the bottom platform 145, but may have a smaller size than the lower shelf 135 to compensate for the shape of rifles being wider at the stock than at the barrel.

Figure 2C:
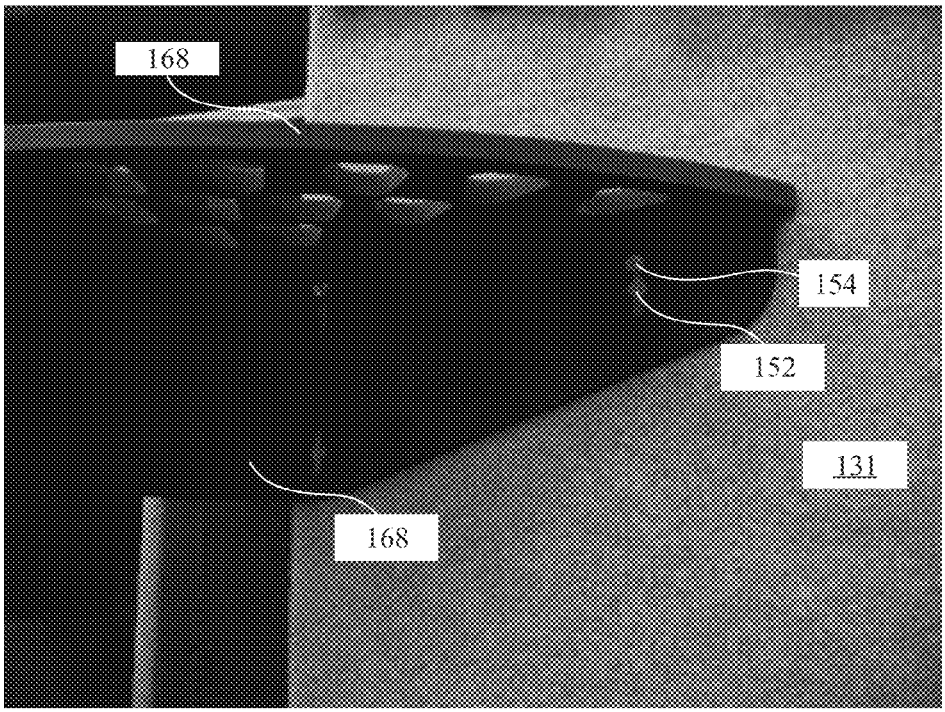

In some embodiments, as shown in FIG. 2B and FIG. 2C the top platform 165 may be coupled perpendicularly (within manufacturing tolerances) with the interior surface 131 of the door 130. The top platform 165 may include an upper mounting bracket 168. The upper mounting bracket 168 may include at least a portion that is perpendicular with the top platform 165 and/or parallel with the interior surface 131 of the door 130. The upper mounting bracket 168, for example, may include one or more holes through which the upper mounting bracket 168 may be secured with the interior surface 131 of the door 130 using a fastener such as, for example, screws and/or bolts. In some embodiments, the upper mounting bracket 168 may include a portion that extends upwardly relative to the top platform 165 and/or the interior surface 131 of the door 130. In some embodiments, the mounting bracket may include a portion that extends downwardly relative to the top platform 165 and/or the interior surface 131 of the door 130.

The gun safe storage system 100 may not be limited to having two shelves coupled with the interior surface 131 of the door 130. In some embodiments, a third or fourth shelf may be placed between the lower shelf 135 and the upper shelf 160 to stabilize the middle portion of a rifle or to stabilize the barrel of a shorter gun.

In some embodiments, the bottom shelf 140 may be adjustable and/or removable. For example, the lower mounting bracket 148 may include one or more holes 152. The lower mounting bracket 148 may then be secured to the interior surface 131 of the door 130 using screws or bolts 154 placed within the holes 152. In some embodiments, the holes 152 may have a shape that is an oblong rectangle or oval with a larger central circle. The central circle may have a diameter larger than the diameter of the head of the screw or bolt 154 used to secure the lower mounting bracket 148 to the interior surface 131 of the door 130. The oblong shape may have a width that is wider than the shaft of the screw or bolt 154, but less than the diameter of the head of the screw or bolt 154. In this way, for example, the lower mounting bracket 148 may be secured with the interior surface 131 of the door 130 by sliding the circular portion of the holes 152 over the screw or bolt 154 and sliding the lower mounting bracket 148 downward.

In some embodiments, the top shelf 160 may be adjustable and/or removable. For example, the upper mounting bracket 168 may include one or more holes 152. The upper mounting bracket 168 may then be secured to the interior surface 131 of the door 130 using screws or bolts 154 placed within the holes 152. In some embodiments, the holes 152 may have a shape that is an oblong rectangle or oval with a larger central circle. The central circle may have a diameter larger than the diameter of the head of the screw or bolt 154 used to secure the upper mounting bracket 168 to the interior surface 131 of the door 130. The oblong shape may have a width that is wider than the shaft of the screw or bolt 154, but less than the diameter of the head of the screw or bolt 154. In this way, for example, the upper mounting bracket 168 may be secured with the interior surface 131 of the door 130 by sliding the circular portion of the holes 152 over the screw or bolt 154 and sliding the upper mounting bracket 168 downward.

In some embodiments, the bottom shelf 140 and/or the top shelf 160 can be moved to any position on the interior surface 131 of the door 130. For example, the bottom shelf 140 and/or the top shelf 160 may be moved vertically or horizontally into new positions on the interior surface 131 of the door 130. In some embodiments, the bottom shelf 140 and/or the top shelf 160 may be aligned vertically relative to one another and/or may be aligned with a vertical edge of the interior surface 131 of the door 130.

Some embodiments include a gun safe having a top shelf and a bottom shelf attached with an interior surface of the gun safe's door configured to store more than one row of guns.

Some embodiments include a gun safe having a top shelf and a bottom shelf attached with an interior surface of a door where the top shelf and/or the bottom shelf extend past an interior surface edge of the gun safe's door.

Some embodiments include a gun safe having a top shelf and a bottom shelf attached with an interior surface of a door where the top shelf and/or the bottom shelf extend half way across an interior surface of the gun safe's door.

Some embodiments include a gun safe having a top shelf and a bottom shelf attached with an interior surface of a door where the top shelf and/or the bottom shelf extend across only a portion of the interior surface of the gun safe's door.

Some embodiments include a gun safe having a wedge shaped top shelf and a wedge shaped bottom shelf attached with an interior surface of the gun safe's door.

Figure 3A:
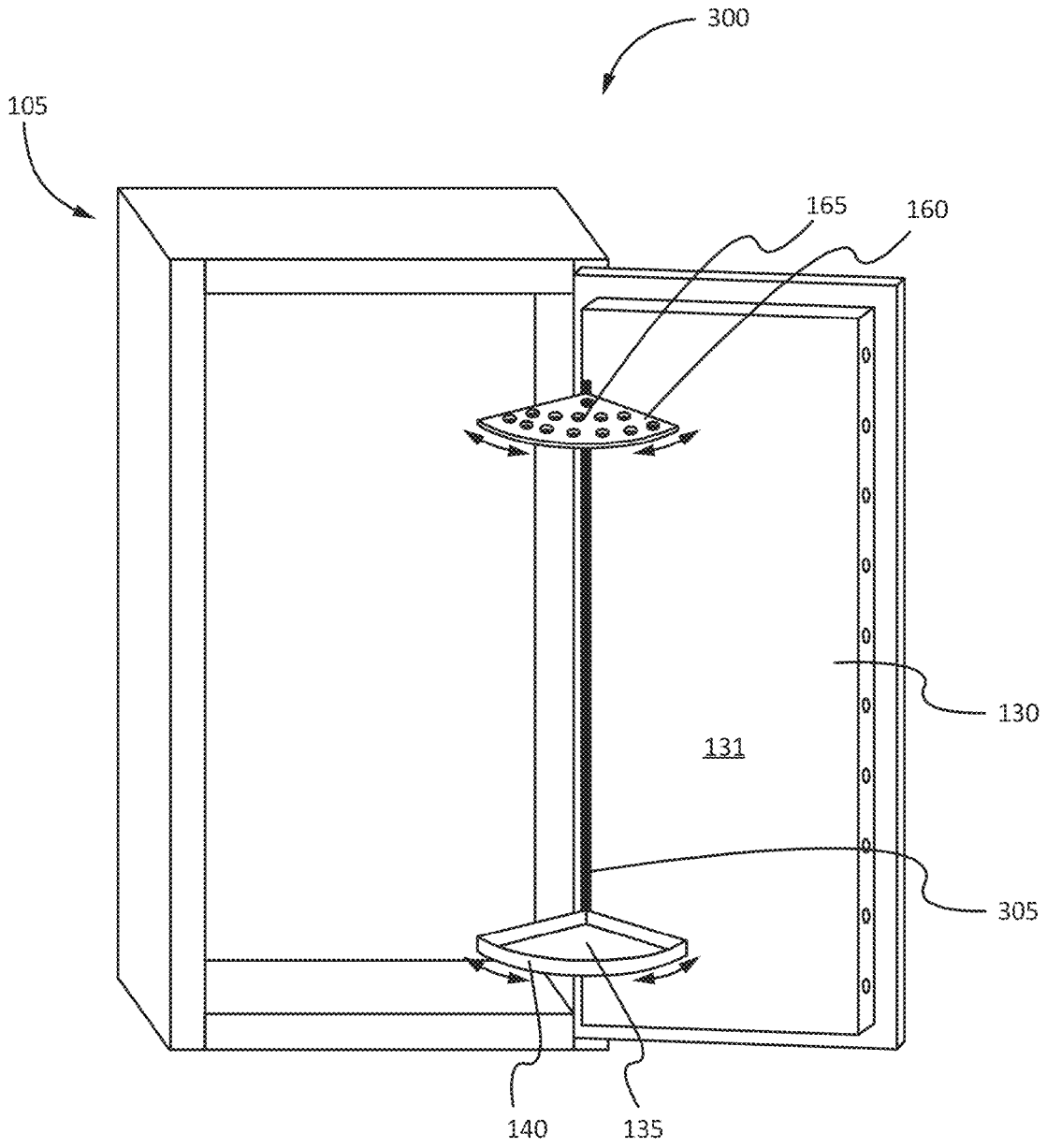
FIG. 3A and FIG. 3B illustrate perspective views of another gun safe storage system according to some embodiments described herein.
Figure 3B:
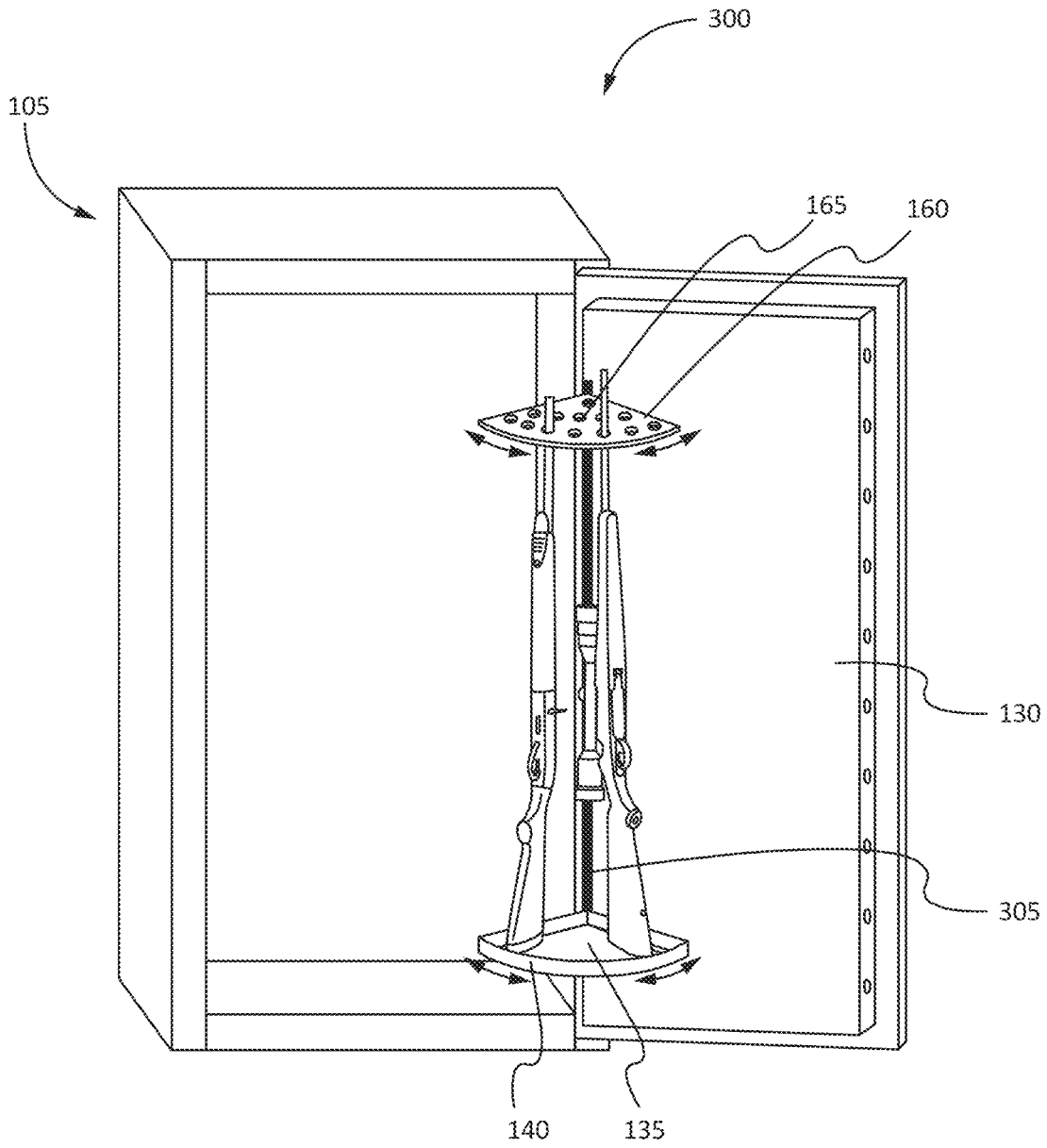

FIG. 3A shows a gun safe storage system 300 according to some embodiments described herein. FIG. 3B shows the gun safe storage system 300 holding a couple of guns. In this embodiment, the lower shelf 135 and the upper shelf 160 are not attached directly with the interior surface 131 of the door 130 but are attached to a pivoting rod 305. The Pivoting rod 305 may be attached with the interior surface 131 of the door 130 and/or the safe body 105. The pivoting rod 305 may allow the two shelves to open and close independent of the interior surface 131 of the door 130. In some embodiments, the pivoting rod 305 can be configured to keep the two shelves aligned. For example, by rotating one shelf, the other shelf may follow so that the guns being stored remain secured. In other embodiments, the pivoting rod 305 is not configured to keep the shelves aligned and thus the two shelves can open and close independent of each other. In some embodiments, the ridge 140 may surrounds all of the edges of the lower shelf 135.

Figure 4A:
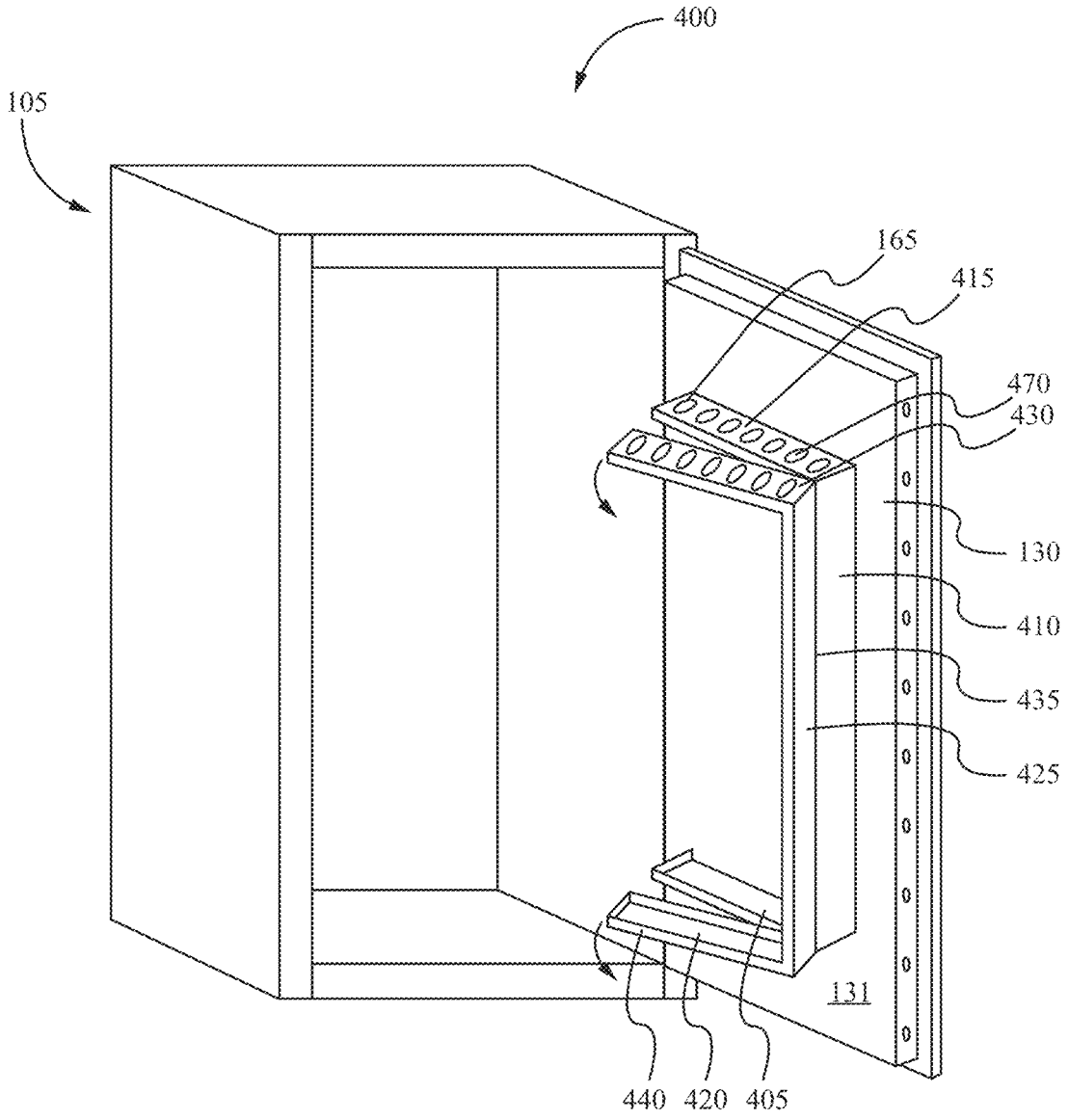
FIG. 4A and FIG. 4B illustrate perspective views of another gun safe storage system according to some embodiments described herein.
Figure 4B:
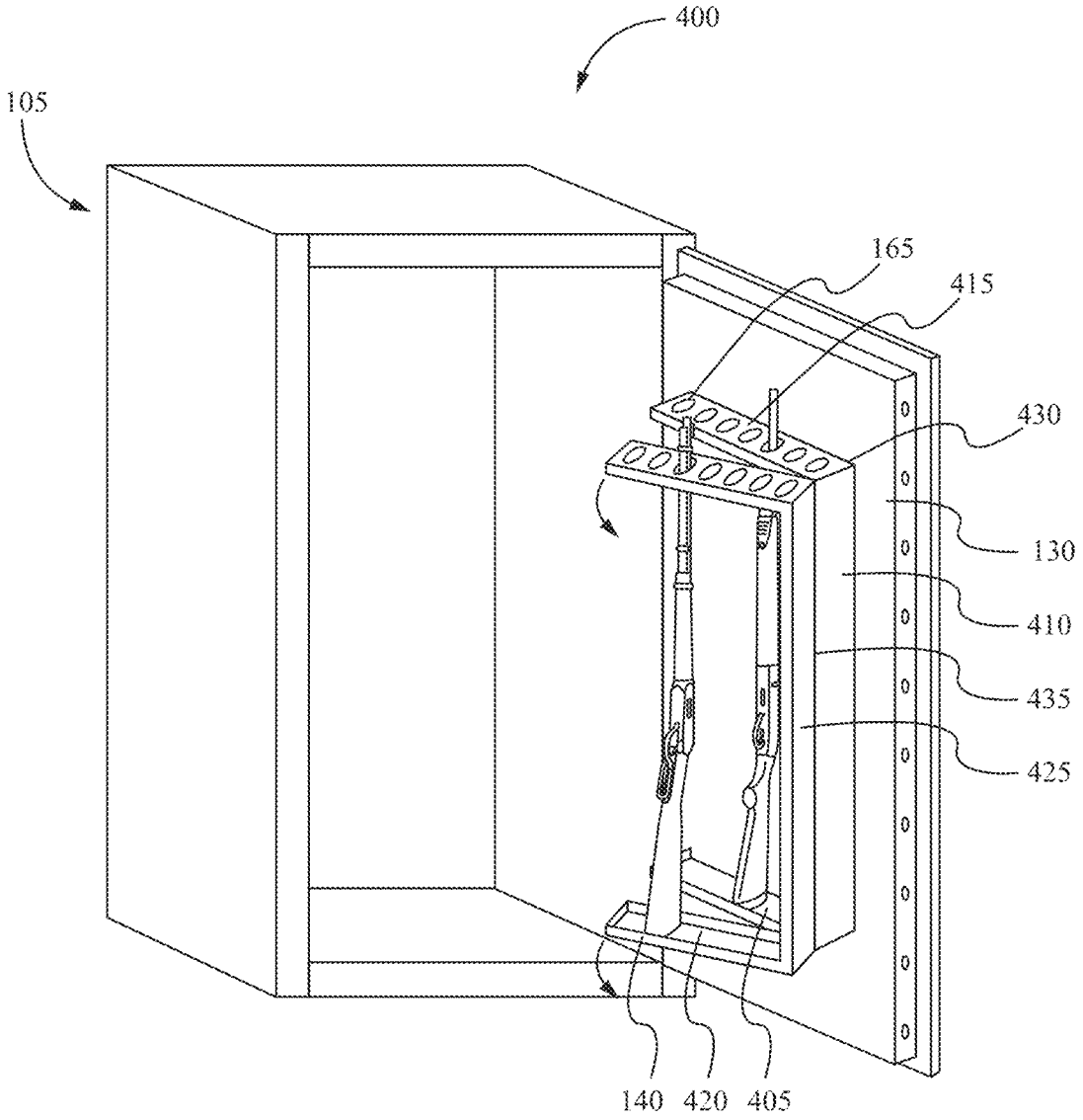

FIGS. 4A and 4B show a flip out gun safe storage system 400 according to some embodiments described herein. In some embodiments, the gun safe storage system 400 includes a first lower shelf 405, a first upper shelf 415, and a first vertical support member 410 attached with the interior surface 131 of the door 130. A mounting bracket may be used to attach the first lower shelf 405, the first upper shelf, and/or the first vertical support member 410 may be coupled with the interior surface 131 of the door 130 such as, for example, with a mounting bracket.

In some embodiments, the first lower shelf 405 may provide a platform to hold the stocks of the guns being stored (see FIG. 4B). In some embodiments, the first upper shelf 415 may secure the barrels of guns with a plurality of holes 470 of any size or shape. In some embodiments, a second row of shelving is provided by a second lower shelf 420 and a second upper shelf 430 that are adjoined by a second vertical member 425. The second row of shelving is attached to the first row of shelving through a hinge 435 such as, for example, a pivoting rod.

When the door 130 is closed, both rows of shelving can be aligned to be adjacent to each other to minimize dead space within safe body 105. When the door 130 is open, the second row of shelving may be rotated (and/or extended) to create one continuous row of shelving, as shown in FIG. 4B. In some embodiments, the first lower shelf 405 and the first upper shelf 415 may be connected by a first vertical support member 410, and similarly, the second lower shelf 420 and the second upper shelf 430 may be connected by a second vertical support member 425. Both first vertical support member 410 and the second vertical support member 425 are optional and/or may provide stability to gun safe storage system 400. In some embodiments, a ridge 440 may surround at least a portion of either or both the first lower shelf 405 and the second lower shelf 420.

Figure 5A:
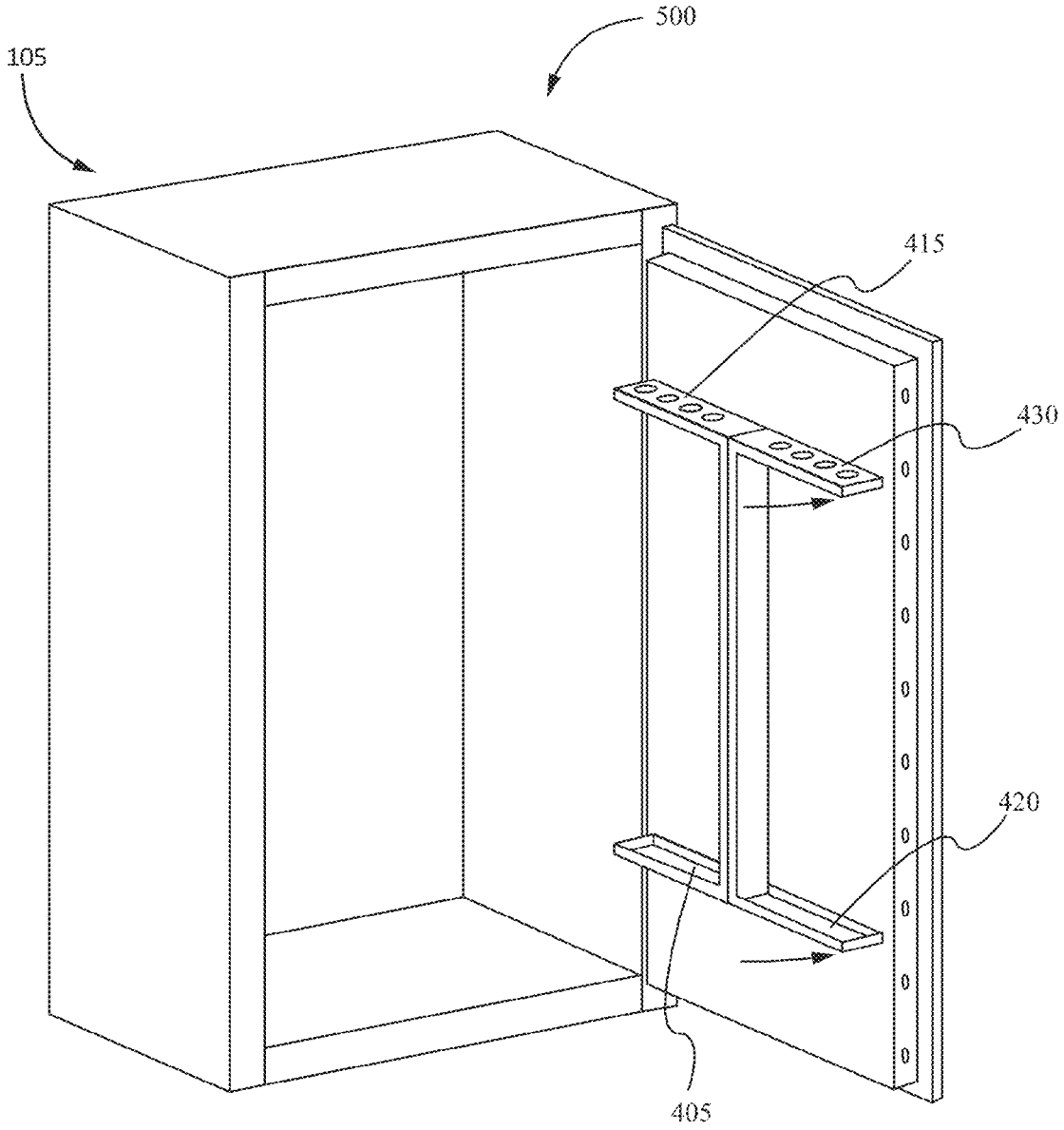
FIG. 5A and FIG. 5B illustrate perspective views of another gun safe storage system according to some embodiments described herein.
Figure 5B:
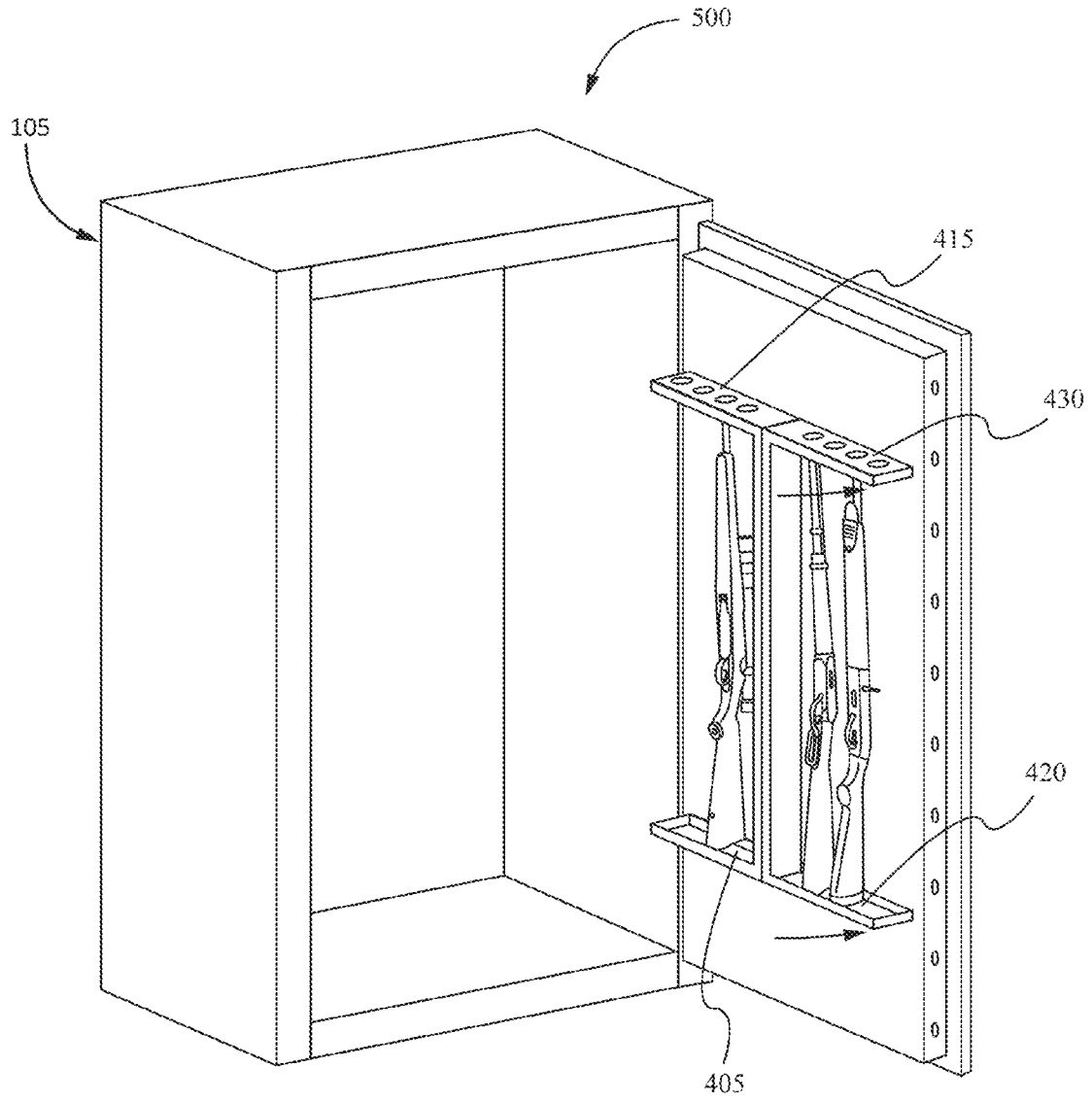

FIGS. 5A and 5B show a flip out gun safe storage system 500 according to some embodiments described herein. In some embodiments, the gun safe storage system 500 is similar to the gun safe storage system 400 shown in FIG. 4A and FIG. 4B but includes fewer holes in the first upper shelf 415 and/or the second upper shelf 430. In some embodiments, the gun safe storage system 500 is similar to the gun safe storage system 400 but extends less than half way across the door when folded and extends less than all the way across the door when unfolded (flipped outward).

Figure 6A:
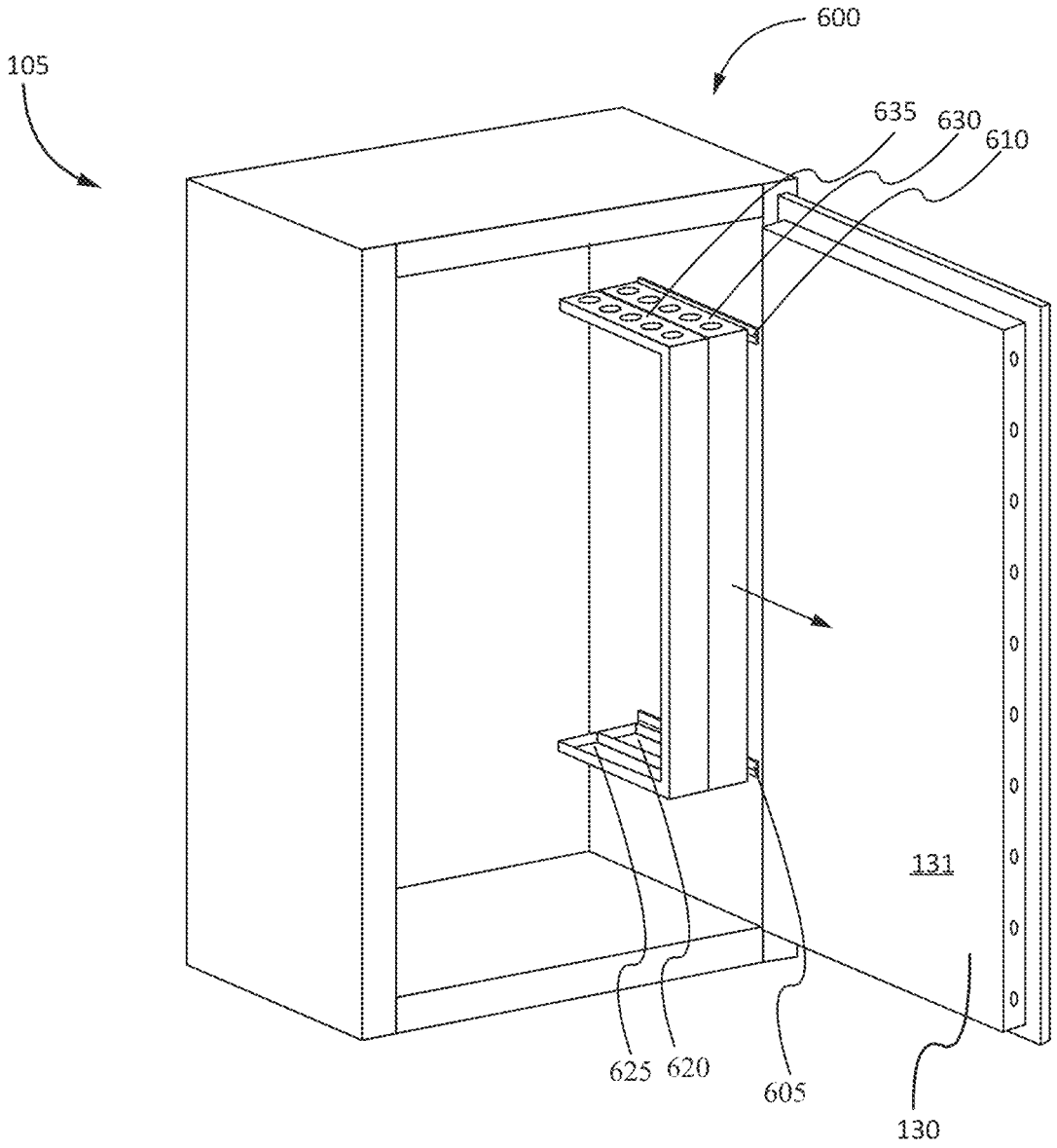
FIG. 6A, FIG. 6B, FIG. 6C, FIG. 6D, and FIG. 6E illustrate perspective views of another gun safe storage system according to some embodiments described herein.
Figure 6B:
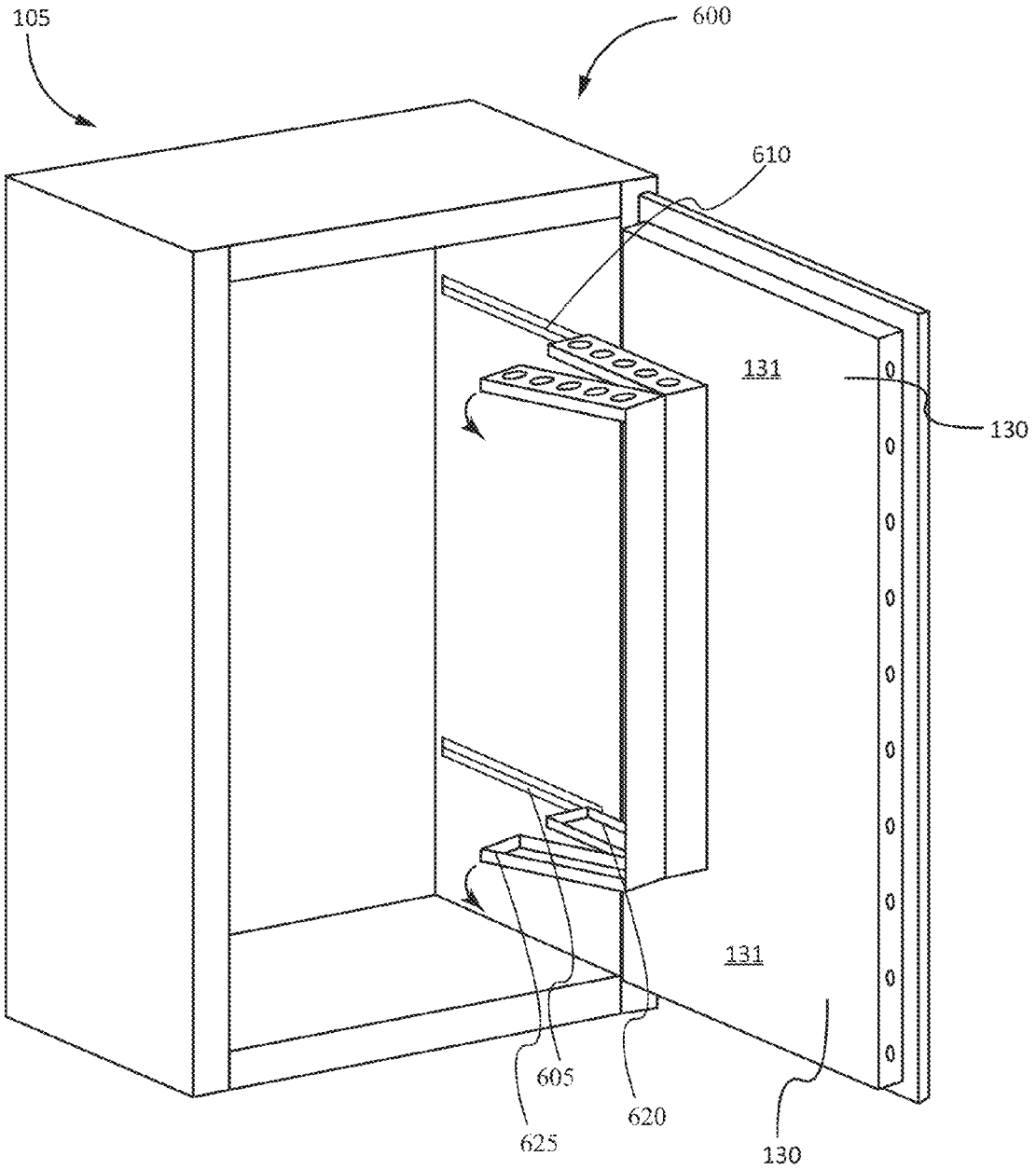
Figure 6C:
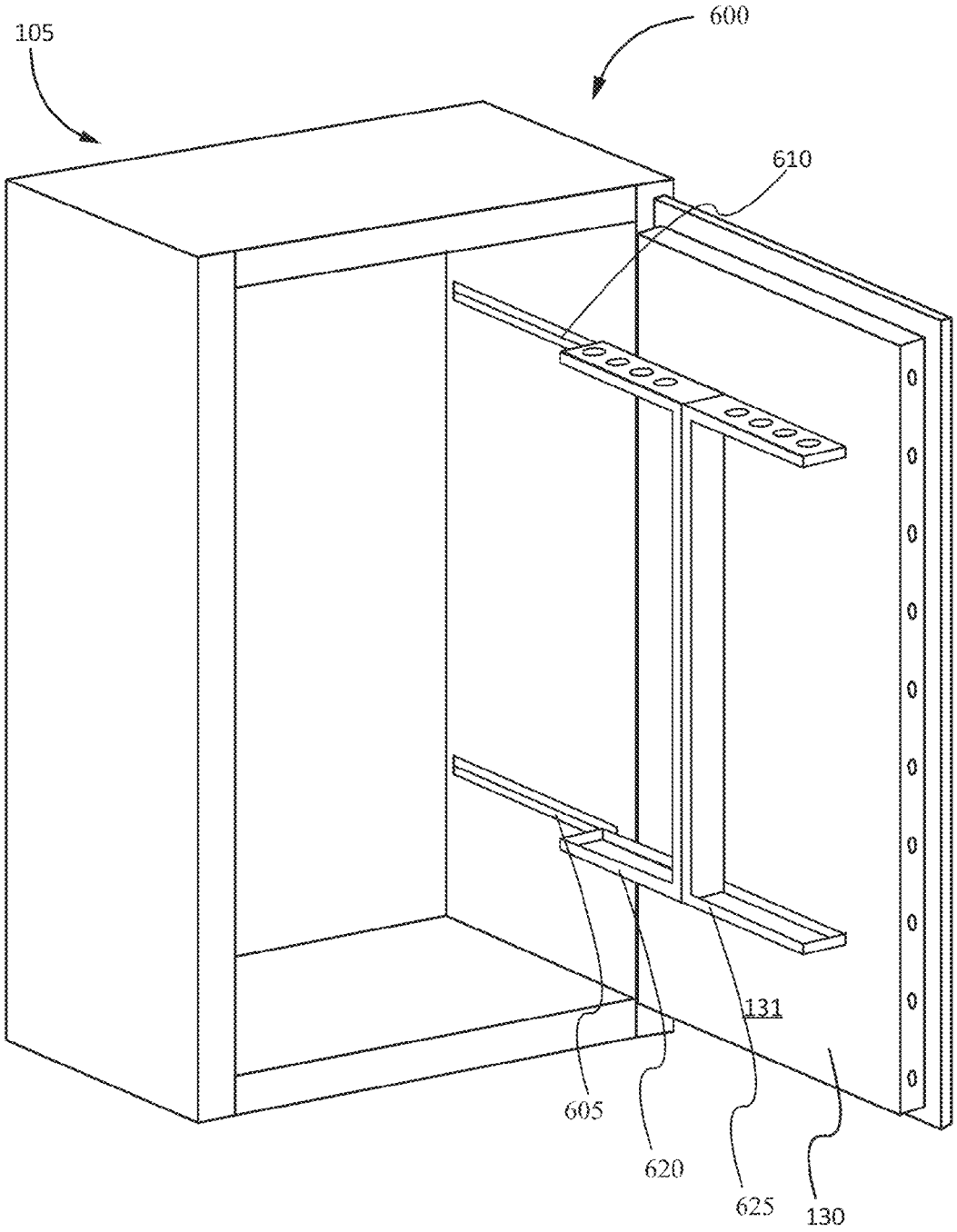
Figure 6D:
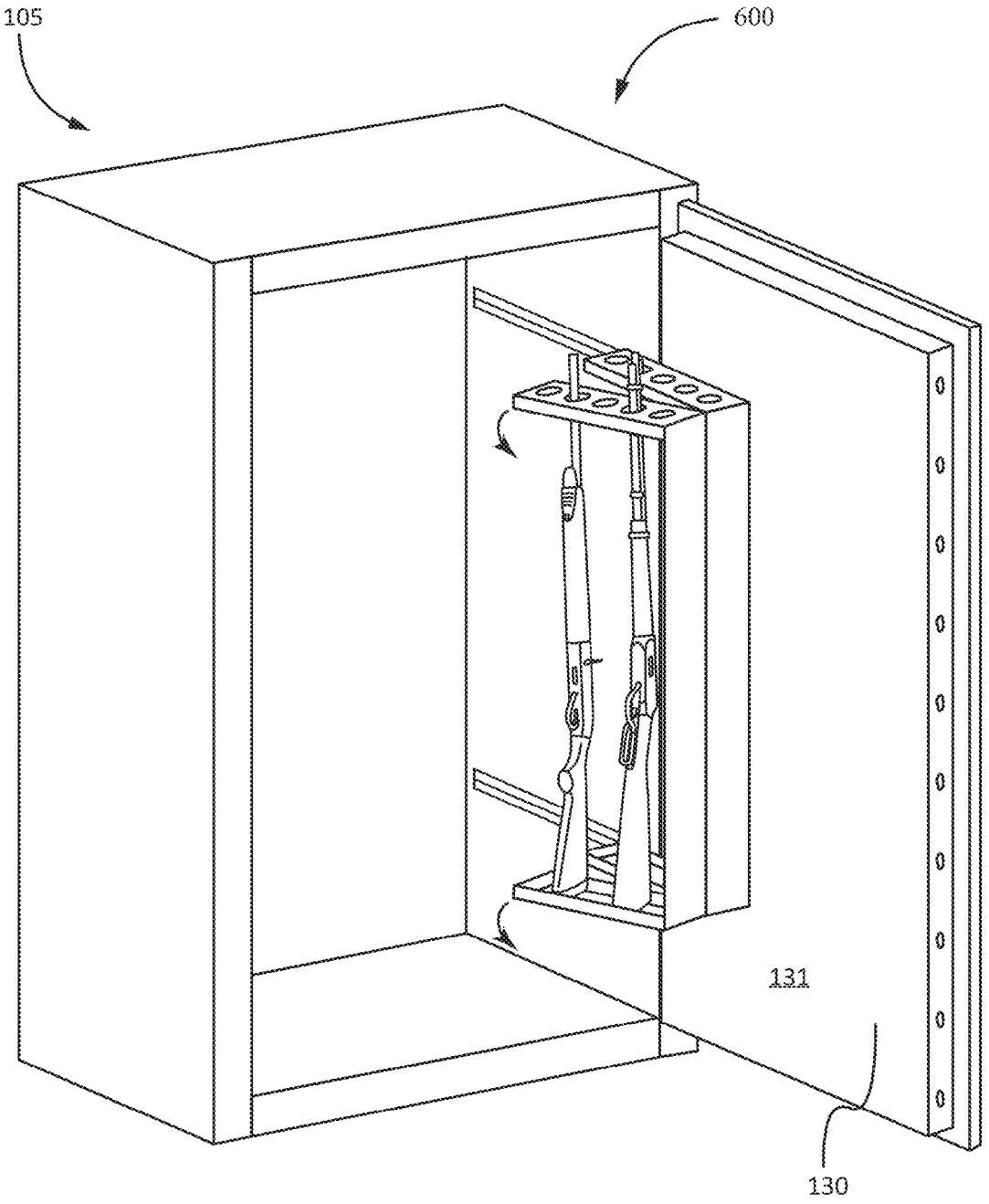
Figure 6E:
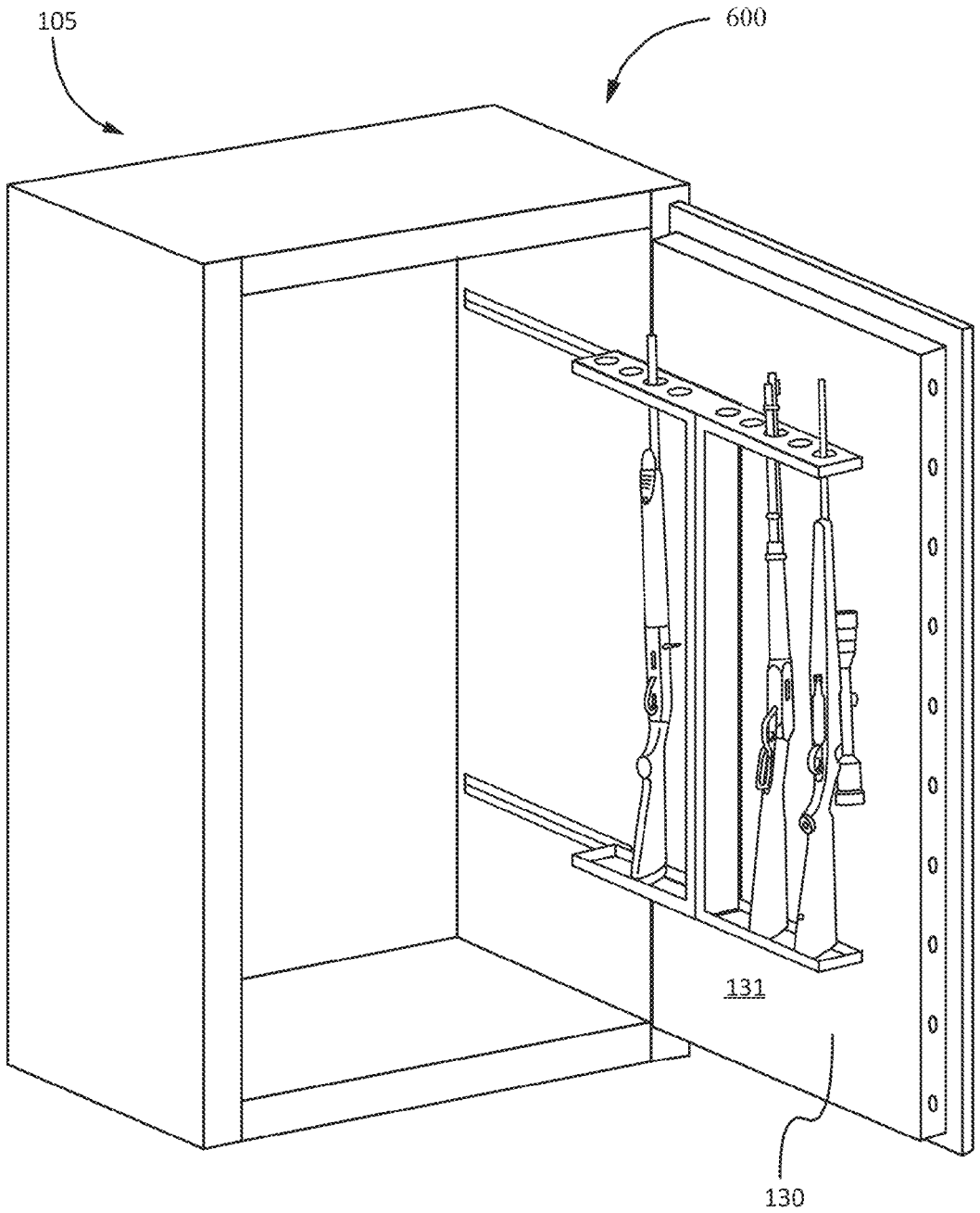

FIG. 6A, FIG. 6B, FIG. 6C, FIG. 6D, and FIG. 6E illustrate an extension and flip-out gun safe storage system 600 according to some embodiments described herein. A track system with a lower track 605 and an upper track 610 may be attached at least to the safe body 105 and possibly with the interior surface 131 of the door 130. As shown in FIG. 6B, the lower track 605 and the upper track 610 may allow the first lower shelf 620, the second lower shelf 625, the first upper shelf 630, and the second upper shelf 635 to slide out from within the safe body 105. In some embodiments, a hinged system may be included like that shown in FIGS. 4A, 4B, 5A and/or 5B that allows the second lower shelf 625 and the second upper shelf 635 to flip outwardly from the first upper lower shelf 620 and the second lower shelf 625. In some embodiments, a non-hinged or non-flip-out storage system with an upper shelf and a lower shelf can be included that may include one or more rows of holes and/or allow one or more rows of guns to be stored. In some embodiments, multiple track systems may be included that allows multiple upper and lower shelf combinations to extend outwardly from within the safe body 105 and/or retract back into the safe body 105.

In some embodiments, the lower track 605 and/or the upper tracks 610 may be coupled only with the interior of the safe body 105 and not coupled with the interior surface 131 of the door 130. In some embodiments, lower track 605 and/or the upper tracks 610 may allow the shelving to extend outward from within the safe body 105. In some embodiments, the lower track 605 and/or the upper tracks 610 include an extension track that may allow the shelving to extend completely out from within the safe body 105.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, it should be understood that the present disclosure has been presented for-purposes of example rather than limitation, and does not preclude inclusion of such modifications, variations, and/or additions to the present subject matter as would be readily apparent to one of ordinary skill in the art.

That which is claimed:

1. A gun safe comprising:

a safe body defined at least by a back, a first side, a second side, a top, a bottom, and a front, the front comprising an opening;

a door coupled with the first side and/or the front and configured to open and close, the door having a height, a width and a thickness;

a lower shelf having a first shape, the first shape having a first edge and a second edge of an equal length and a curved edge, wherein the first edge, the second edge, and the curved edge define a quarter circle shape, wherein the first edge is coupled with the door, wherein the equal length is less than half the width of the door; and an upper shelf coupled with the door, the upper shelf having a second shape and comprising a plurality of holes configured to secure a barrel of a firearm.

2. The gun safe of claim 1, wherein the first shape and the second shape comprise the same shape.

3. The gun safe of claim 1, wherein the quarter circle shape comprises a right-angled wedge shape.

4. The gun safe of claim 1, wherein the lower shelf comprises a platform having the first shape and a mounting bracket perpendicular with the platform.

5. The gun safe of claim 1, wherein the upper shelf comprises a platform having the second shape and a mounting bracket perpendicular with the platform.

6. The gun safe of claim 1, wherein the lower shelf comprises a platform having a ridge extending along at least a portion of the length of one or more edges of the platform.

7. The gun safe of claim 1, wherein at least a portion of the top shelf extends past an edge of the door.

8. The gun safe of claim 1, wherein the plurality of holes are arranged in at least two rows.

9. The gun safe of claim 1, wherein the upper shelf and the lower shelf are adjustable.

10. The gun safe of claim 1, wherein the first edge is removably coupled with the door.

11. The gun safe of claim 1, wherein the upper shelf is removably coupled with the door.

12. A gun storage system comprising:

a safe body;

a door coupled with the safe body and configured to open and close, the door having a height, a width and a thickness;

a lower shelf coupled with the door and having a first shape, the lower shelf comprising a ridge extending along at least a portion of the length of one or more edges and a mounting bracket that is coupled with and perpendicular to the lower shelf, the first shape having a first edge and a second edge of an equal length and a curved edge, wherein the first edge, the second edge, and the curved edge define a quarter circle shape, wherein the equal length is less than half the width of the door; and an upper shelf coupled with the door and having a second shape, the upper shelf comprising a plurality of holes configured to secure a barrel of a firearm and a mounting bracket that is coupled with and perpendicular to the upper shelf.

13. The gun storage system of claim 12, wherein the first shape and the second shape comprise the same shape.

14. The gun storage system of claim 12, wherein the quarter circle shape comprises a right-angled wedge shape.

15. The gun storage system of claim 12, wherein at least a portion of the top shelf extends past an edge of the door.

16. The gun storage system of claim 12, wherein the plurality of hoes are arranged in at least two rows.

17. The gun storage system of claim 12, wherein the upper shelf and the lower shelf are adjustable.

18. The gun storage system of claim 12, wherein the lower shelf is removably coupled with the door.

19. The gun storage system of claim 12, wherein the upper shelf is removably coupled with the door.

* * * * *